US010024342B2

(12) United States Patent
Terao et al.

(10) Patent No.: US 10,024,342 B2
(45) Date of Patent: Jul. 17, 2018

(54) LOAD SENSING CONTROL CIRCUIT

(71) Applicant: KYB Corporation, Tokyo (JP)

(72) Inventors: Takeshi Terao, Kanagawa (JP); Masayuki Nakamura, Kanagawa (JP)

(73) Assignee: KYB Corporation, Tokyo (JP)

( * ) Notice: Subject to any disclaimer, the term of this patent is extended or adjusted under 35 U.S.C. 154(b) by 23 days.

(21) Appl. No.: 14/898,161

(22) PCT Filed: Apr. 13, 2015

(86) PCT No.: PCT/JP2015/061398
§ 371 (c)(1),
(2) Date: Dec. 14, 2015

(87) PCT Pub. No.: WO2015/182268
PCT Pub. Date: Dec. 3, 2015

(65) Prior Publication Data

US 2016/0138620 A1 May 19, 2016

(30) Foreign Application Priority Data

May 26, 2014 (JP) ..... 2014-108124

(51) Int. Cl.
*F15B 13/06* (2006.01)
*F15B 11/16* (2006.01)
(Continued)

(52) U.S. Cl.
CPC ..... *F15B 11/163* (2013.01); *F15B 11/162* (2013.01); *F15B 13/026* (2013.01); *F15B 13/06* (2013.01); *F15B 21/005* (2013.01); *F15B 2211/20546* (2013.01); *F15B 2211/253* (2013.01); *F15B 2211/3054* (2013.01);
(Continued)

(58) Field of Classification Search
CPC ..... F15B 11/163; F15B 21/005; F15B 11/05; F15B 13/0417; F15B 11/162; F15B 13/026; F15B 13/06
See application file for complete search history.

(56) References Cited

U.S. PATENT DOCUMENTS

| | | | | |
|---|---|---|---|---|
| 5,186,000 A * | 2/1993 | Hirata | E02F 9/2225 | 60/420 |
| 6,367,365 B1 * | 4/2002 | Weickert | F15B 11/003 | 60/422 |
| 2013/0153043 A1 * | 6/2013 | Payne | F15B 11/163 | 137/14 |

FOREIGN PATENT DOCUMENTS

| | | |
|---|---|---|
| JP | 04-136506 A | 5/1992 |
| JP | H06-159309 A | 6/1994 |
| JP | 2004-239378 A | 8/2004 |

* cited by examiner

*Primary Examiner* — Michael Leslie
*Assistant Examiner* — Abiy Teka
(74) *Attorney, Agent, or Firm* — Rabin & Berdo, P.C.

(57) ABSTRACT

A pump discharge amount is divided in accordance with switch amounts of respective switch valves by leading load pressures of actuators to which compensator valves are connected to respective first pressure chambers of the compensator valves, leading a maximum load pressure selected by a selection unit to respective second pressure chambers of the compensator valves, and controlling respective openings of the compensator valves in accordance with respective pressure actions between the respective pressure chambers. A drain passage is provided to connect the first pressure chamber of the compensator valve to a tank, and a flow dividing ratio modification valve is provided to control a pressure in the first pressure chamber.

7 Claims, 2 Drawing Sheets

(51) Int. Cl.
*F15B 13/02* (2006.01)
*F15B 21/00* (2006.01)

(52) U.S. Cl.
CPC ..... *F15B 2211/351* (2013.01); *F15B 2211/40515* (2013.01); *F15B 2211/40553* (2013.01); *F15B 2211/50572* (2013.01); *F15B 2211/5756* (2013.01); *F15B 2211/71* (2013.01); *F15B 2211/781* (2013.01)

LOAD SENSING CONTROL CIRCUIT

TECHNICAL FIELD

This invention relates to a load sensing control circuit that divides a flow in accordance with openings of respective switch valves, irrespective of load pressure variation in a plurality of actuators.

BACKGROUND ART

A load sensing control circuit described in JP2004-239378A is available in the prior art.

In the load sensing control circuit described in JP2004-239378A, a fluid discharged from a variable displacement pump is divided, whereupon the divided fluid is supplied to a first actuator via a first switch valve and a first compensator valve, and to a second actuator via a second switch valve and a second compensator valve. Further, a higher maximum load pressure of maximum load pressures in head side chambers of the respective actuators is selected and led to a regulator provided in the variable displacement pump, whereupon a discharge amount of the variable displacement pump is controlled in accordance with the maximum load pressure led thereto. The first compensator valve and the second compensator valve function to keep a flow dividing ratio determined in accordance with respective openings of the first switch valve and the second switch valve constant even when a load pressure of the first actuator or the second actuator varies.

SUMMARY OF INVENTION

In a load sensing control circuit that keeps a flow dividing ratio corresponding to openings of respective switch valves constant irrespective of load pressure variation in a plurality of actuators, a desire to modify the flow dividing ratio with respect to a specific actuator alone may arise even when the flow dividing ratio is set in advance in accordance with switch amounts of the switch valves.

In the case of a power shovel, for example, a boom cylinder may be made larger than a normal actuator in order to handle a larger load. In this case, the load pressure in the boom cylinder becomes extremely high, and when this high load pressure is led to the regulator of the variable displacement pump, the discharge amount of the variable displacement pump becomes excessively small.

When the discharge amount of the variable displacement pump remains in an excessively reduced condition, a flow supplied to the boom cylinder also decreases, leading to a reduction in an operating speed of the boom cylinder. In a case of this type, therefore, the flow dividing ratio of the boom cylinder is preferably made larger than the flow dividing ratio of the other actuators.

Further, even when all of the actuators are identical to conventional actuators, depending on the type of operation, a desire to increase the flow dividing ratio with respect to a specific actuator may arise.

In the conventional load sensing control circuit described above, however, once the switch amounts of the respective switch roles are determined, the flow dividing ratio corresponding thereto remains constant at all times, making it impossible to respond to a desire to modify the flow dividing ratio.

An object of this invention is to provide a load sensing control circuit in which a flow dividing ratio determined in accordance with switch amounts of respective switch valves can be modified.

A load sensing control circuit according to an aspect of this invention divides a pump discharge amount in accordance with switch amounts of a plurality of switch valves, and includes a drain passage that connects a first pressure chamber of at least one compensator valve to a tank, and a pressure control unit that controls a pressure in the first pressure chamber connected to the tank.

DESCRIPTION OF EMBODIMENTS

An embodiment of this invention will be described below with reference to the figures.

Figure 1:
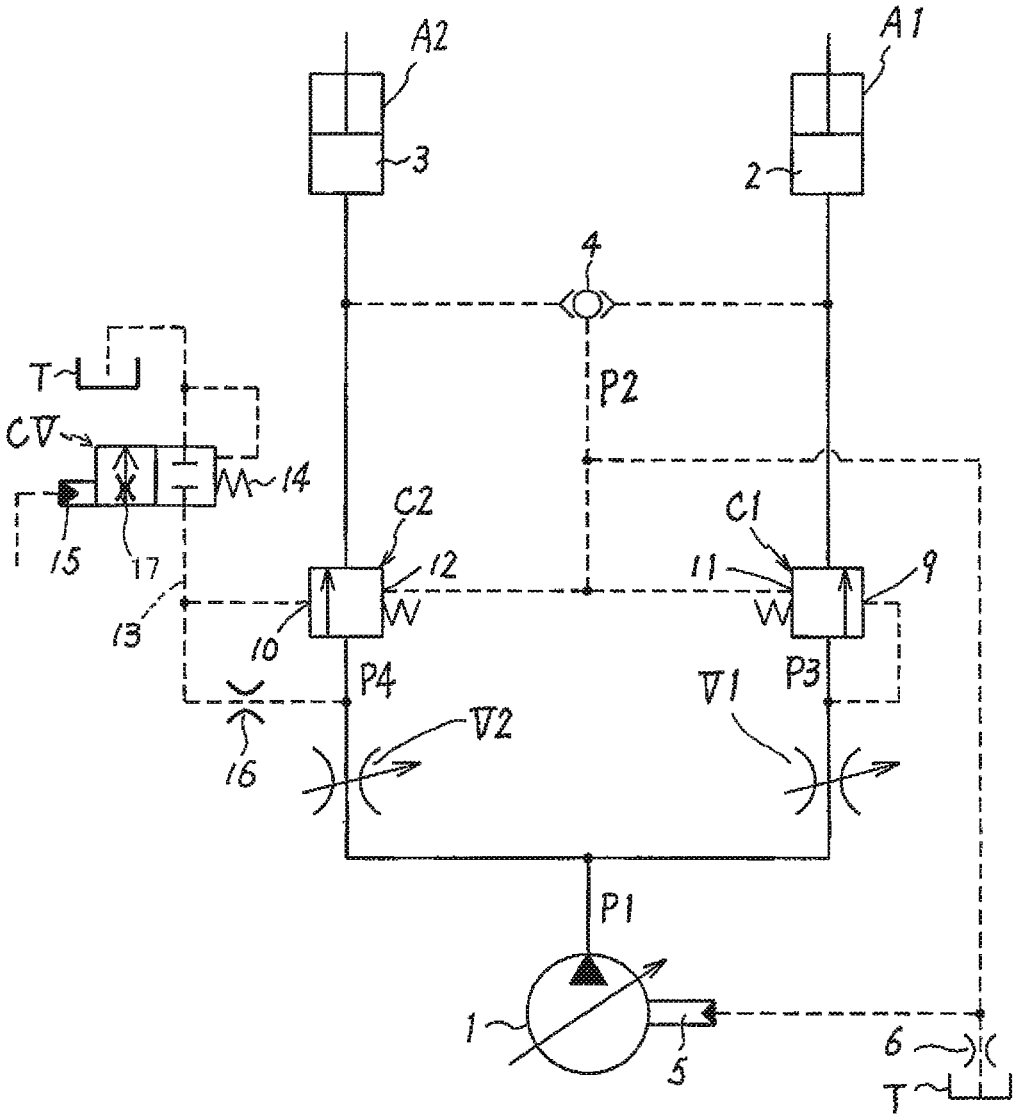
FIG. 1 is a circuit diagram showing an embodiment of this invention.

A load sensing control circuit according to this embodiment will now be described using FIG. 1.

Switch valves V1, V2 are connected to a variable displacement pump 1. Spools, not shown in the figure, are incorporated respectively into the switch valves V1, V2 to be free to slide. It should be noted that respective openings of the switch valves V1, V2 can be varied in accordance with strokes of the respective spools, and therefore, in FIG. 1, the switch valves V1, V2 are indicated by symbols for variable orifices.

Moreover, as long as the respective openings of the switch valves V1, V2 can be varied in accordance with the strokes of the spools, any type of switch valve may be used.

A compensator valve C1 is connected to a downstream side of the switch valve V1, and an actuator A1 is connected to a downstream side of the compensator valve C1. Further, a compensator valve C2 is connected to a downstream side of the switch valve V2, and an actuator A2 is connected to a downstream side of the compensator valve C2. In other words, the compensator valves C1, C2 are provided in connecting passages respectively connecting the switch valves V1, V2 to the actuators A1, A2. Furthermore, respective heads side chambers 2, 3 of the actuators A1, A2 are connected to a selection unit 4 constituted by a shuttle valve that selects a maximum load pressure, and a higher maximum load pressure P2 of the maximum load pressures in the head side chambers 2, 3 is selected by the selection unit 4.

It should be noted that the selection unit 4 is not necessarily limited to a shuttle valve, and as long as the selection unit 4 has a function for selecting the maximum load pressure, no structural limitations need be applied thereto.

Moreover, in this embodiment, only two actuators are shown, but as long as the actuators are systematically integrated with the load sensing control circuit, there are no limitations on the number of actuators. It should be noted, however, that in this case, the respective actuators must be associated with compensator valves.

The maximum load pressure P2 selected by the selection unit 4 is led to a regulator 5 provided in the variable displacement pump 1. A tilt angle of the variable displacement pump 1 is controlled in accordance with the maximum load pressure P2 led thereto, whereby the variable displacement pump 1 maintains a discharge pressure P1 and a discharge amount corresponding to the maximum load pressure P2.

A tank T and an orifice 6 for maintaining a pressure between the regulator 5 and the tank T are also provided.

The compensator valve C1 is provided with a first pressure chamber 9 and a second pressure chamber 11, and an opening thereof is controlled by a pressure action between the first pressure chamber 9 and the second pressure chamber 11. The compensator valve C2 is provided with a first pressure chamber 10 and a second pressure chamber 12, and an opening thereof is controlled by a pressure action between the first pressure chamber 10 and the second pressure chamber 12.

More specifically, spools (referred to hereafter as "compensator spools"), not shown in the figure, are provided respectively in the compensator valves C1, C2 to be free to slide and positioned such that one end of each compensator spool faces the first pressure chamber 9, 10 and another end of each compensator spool faces the second pressure chamber 11, 12.

Movement positions of the compensator spools are controlled by the pressure actions between the first pressure chambers 9, 10 and the second pressure chambers 11, 12. Openings of passages which connect valves V1, V2 to the actuators A1, A2 are controlled in accordance with the respective movement positions of the compensator spools.

It should be noted that there are no structural limitations on the compensator valves C1, C2 as long as one end of each compensator spool faces the first pressure chamber 9, 10, the other end faces the second pressure chamber 11, 12, and in a position where acting forces of respective pressures in the first pressure chambers 9, 10 and the second pressure chambers 11, 12 are balanced, the openings of the compensator valves C1, C2 are maintained.

A pressure P3 between the compensator valve C1 and the switch valve V1 is led to the first pressure chamber 9 of the compensator valve C1, and the maximum load pressure P2 selected by the selection unit 4 is led to the second pressure chamber 11. Further, a pressure P4 between the compensator valve C2 and the switch valve V2 is led to the first pressure chamber 10 of the compensator valve C2, and the maximum load pressure P2 selected by the selection unit 4 is led to the second pressure chamber 12. It should be noted that the pressures P3, P4 are lower than a discharge pressure P1 of the variable displacement pump 1 due to pressure loss corresponding to the openings of the switch valves V1, V2.

Further, the pressures P3, P4 vary respectively in proportion to the load pressures of the actuators A1, A2. For example, when the load pressures of the actuators A1, A2 are high, the pressures P3, P4 increase accordingly, and when the load pressures decrease, the pressures P3, P4 also decrease.

Hence, the pressures P3, P4 that vary in accordance with the load pressures of the actuators A1, A2 are led to the respective first pressure chambers 9, 10 of the compensator valves C1, C2.

The compensator spools of the compensator valves C1, C2 are respectively maintained in positions where the maximum load pressure P2 and the pressures P3, P4 are balanced, and in this balanced position, the openings of the compensator valves C1, C2 are maintained.

For example, as the pressures P3, P4 led to the first pressure chambers 9, 10 decrease in relation to the maximum load pressure P2 led to the opposite side second pressure chambers 11, 12, the openings of the compensator valves C1, C2 decrease, and as relative differences between the maximum load pressure P2 and the pressures P3, P4 decrease, the openings of the compensator valves C1, C2 increase.

When the switch valves V1, V2 are switched to a neutral position, meanwhile, the switch valves V1, V2 are maintained at openings corresponding to a switch amount, and a ratio between the respective openings of the switch valves V1, V2 serves as a flow dividing ratio for dividing the discharge amount of the variable displacement pump 1 between the actuators A1, A2.

However, even assuming that the flow dividing ratio determined in accordance with the openings of the switch valves V1, V2 is constant, when the load pressures of the actuators A1, A2 vary, the flow dividing ratio determined by the openings of the switch valves V1, V2 cannot be maintained. For example, the load pressures of the actuators A1, A2 may vary such that the load pressure of one actuator becomes lower than the load pressure of the other actuator. At this time, even when the openings of the switch valves V1, V2 are not varied, a fluid discharged by the variable displacement pump 1 flows in a larger amount to the actuator having the lighter load, and as a result, the flow dividing ratio determined in accordance with the openings of the switch valves V1, V2 cannot be maintained.

The compensator valves C1, C2 function to keep the flow dividing ratio determined in accordance with the openings of the switch valves V1, V2 constant even when the load pressures of the actuators A1, A2 vary. A principle of this function will now be described.

It is assumed in the following description that the actuator A1 is maintained at the maximum load pressure P2, the load pressure of the actuator A2 is lower than the maximum load pressure P2, and the initially set openings of the switch valves V1, V2 do not vary.

In this case, the discharge pressure P1 of the variable displacement pump 1 is of course the highest. The pressure P3 is maintained at a higher pressure than the load pressure of the actuator A1, or in other words the maximum load pressure P2, by an amount corresponding to pressure loss in the fluid flowing through the compensator valve C1. Accordingly, a relationship of P1>P3>P2 is maintained between the respective pressures.

While the relationship described above is maintained, the compensator spool of the compensator valve C1 is held in a position where the acting force of the pressure P3 in the first pressure chamber 9 and the acting force of the maximum load pressure P2 in the second pressure chamber 11 are balanced, and as a result, the compensator valve C1 is maintained at the opening obtained in the position where the compensator spool is balanced.

When the load pressure of the actuator A1, or in other words the maximum load pressure P2, varies, the opening of the compensator valve C1 varies in accordance with the variation in the maximum load pressure P2, and the pressure P3 varies in accordance with the variation in the opening of the compensator valve C1. When the opening of the compensator valve C1 increases, the pressure loss in the fluid passing through the compensator valve C1 decreases accordingly. Conversely, when the opening of the compensator valve C1 decreases, the pressure loss increases.

Further, the pressure P4 on the actuator A2 side is maintained at a higher pressure than the load pressure of the actuator A2 by an amount corresponding to pressure loss in the fluid passing through the compensator valve C2. It should be noted, however, that a relative difference between the pressure P4 and the maximum load pressure P2 differs according to the load pressure of the actuator A2.

The compensator spool of the compensator valve C2 is held in a position where the acting force of the pressure P4 in the first pressure chamber 10 and the acting force of the maximum load pressure P2 in the second pressure chamber 12 are balanced, and as a result, the compensator valve C2 is maintained at the opening obtained in the position where the compensator spool is balanced.

When the pressure P4 varies in accordance with variation in the load pressure of the actuator A2, the opening of the compensator valve C2 varies in accordance with the variation in the pressure P4. When the opening of the compensator valve C2 increases, the pressure loss decreases accordingly. Conversely, when the opening of the compensator valve C2 decreases, the pressure loss increases.

When the maximum load pressure of the actuator A1 remains constant and the load pressure of the actuator A2 varies in a decreasing direction, the pressure P4 decreases accordingly. At this time, however, the opening of the compensator valve C2 decreases, and therefore the pressure loss in the fluid passing through the compensator valve C2 increases. When the pressure loss increases in this manner, the pressure P4 remains constant even after a reduction in the load pressure of the actuator A2.

Hence, the pressure P4 on the upstream side of the compensator valve C2 is kept constant irrespective of variation in the load pressure of the actuator A2. When the pressure P4 is kept constant irrespective of variation in the load pressure of the actuator A2 in this manner, a differential pressure between front and rear sides of the switch valve V2 also remains constant. When the differential pressure between the front and rear sides of the switch valve V2 remains constant, a flow passing through the switch valve V2 remains constant irrespective of variation in the load pressure of the actuator A2. In other words, the flow dividing ratio determined in accordance with the openings of the switch valves V1, V2 remains constant irrespective of variation in the load pressure.

In this embodiment, a drain passage 13 is provided to connect the first pressure chamber 10 of the compensator valve C2 provided on the actuator A2 side to a tank T, and a flow dividing ratio modification valve CV is provided in the drain passage 13 as a pressure control unit for controlling the pressure in the first pressure chamber 10.

The flow dividing ratio modification valve CV is provided on the side of the actuator in which the flow dividing ratio is to be reduced. In this embodiment, a case in which the flow dividing ratio on the actuator A2 side is reduced in order to secure a relatively large supply flow on the actuator A1 side is envisaged, and therefore the flow dividing ratio modification valve CV is connected to the compensator valve C2 on the actuator A2 side.

The flow dividing ratio modification valve CV is configured such that a spring force of a spring 14 acts on one end of a spool, and a pilot chamber 15 is provided on an opposite side to the spring 14.

The flow dividing ratio modification valve CV can be switched between a throttle position and a closed position, and is normally held in the closed position, indicated as a normal position in the figure, by an action of the spring force of the spring 14. When a pressure action of the pilot chamber 15 overcomes the spring force of the spring 14, the flow dividing ratio modification valve CV is switched to the throttle position, indicated as a left side position in the figure.

When the flow dividing ratio modification valve CV is in the closed position, communication between the first pressure chamber 10 of the compensator valve C2 and the tank T is blocked, and therefore the compensator valve C2 operates as described above.

When the flow dividing ratio modification valve CV is switched to the throttle position, however, the first pressure chamber 10 of the compensator valve C2 communicates with the tank T via a first throttle portion 17. Accordingly, the pressure in the first pressure chamber 10 at this time is set to be lower than the pressure in the first pressure chamber 10 when the flow dividing ratio modification valve CV is in the closed position.

As a result, a relative difference between the pressure in the first pressure chamber 10 and the maximum load pressure P2 increases such that the compensator valve C2 is maintained at a minimum opening.

When the compensator valve C2 is maintained at the minimum opening, the flow supplied to the actuator A2 side decreases, and therefore a relative increase corresponding to the reduction in the flow supplied to the actuator A2 side is secured in the flow supplied to the actuator A1.

The flow dividing ratio modification valve CV is capable of varying an opening of the first throttle portion 17 in the throttle position by controlling a pilot pressure introduced into the pilot chamber 15. The opening of the first throttle portion 17 may be varied in stages in response to switching of the flow dividing ratio modification valve CV, or may be varied continuously.

In either case, as long as the opening of the first throttle portion 17 can be adjusted freely, the pressure in the first pressure chamber 10 of the compensator valve C2 can be set freely in accordance with the condition on the actuator A1 side, where a relatively large supply flow is to be secured.

It should be noted that the flow dividing ratio modification valve CV may be configured such that the opening of the first throttle portion 17 is switched manually, and such that the pilot pressure used when operating a specific actuator in which a large flow is to be secured, for example, is led to the pilot chamber 15.

Further, the flow dividing ratio modification valve CV may be provided in relation to a plurality of actuators or in relation to all of the actuators, as long as the flow dividing ratio modification valve CV is provided at least on the side of the actuator in which the flow dividing ratio is to be reduced.

Furthermore, an orifice 16 constituting a second throttle portion is provided in a passage that connects the flow dividing ratio modification valve CV to a passage between the switch valve V2 and the compensator valve C2. The orifice 16 is set to have a fixed opening.

The orifice 16 functions as a damper orifice with respect to the compensator valve C2.

Figure 2:
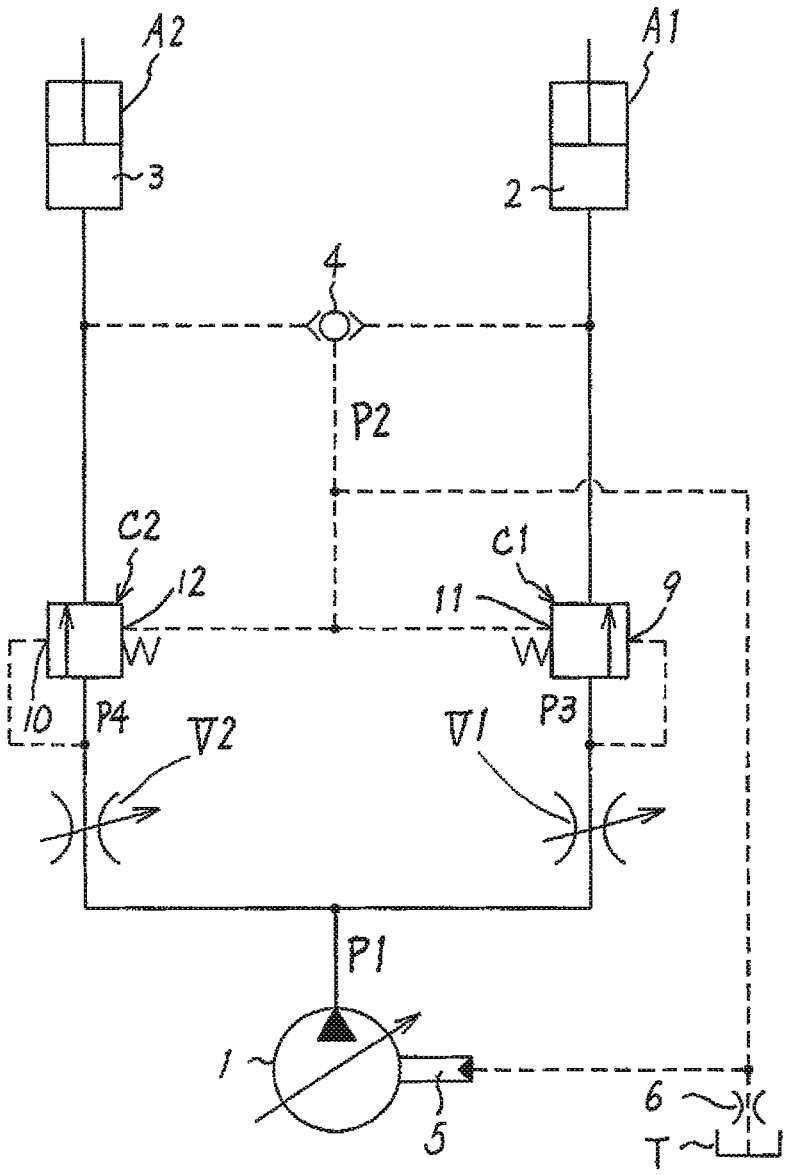
FIG. 2 is a view showing a conventional load sensing control circuit.

A comparative example of this embodiment will now be described using FIG. 2.

In the comparative example, the drain passage 13, the flow dividing ratio modification valve CV, and the orifice 16 of this embodiment are not provided.

It is therefore impossible to modify the flow dividing ratio in relation to a specific actuator alone. In the case of a power shovel, for example, it may be desirable to make the flow dividing ratio of a boom cylinder larger than the flow dividing ratios of the other actuators. In the comparative example, however, it is impossible to modify the flow dividing ratio in relation to a specific actuator alone, and therefore the flow supplied to the boom cylinder decreases, leading to a reduction in an operating speed of the boom cylinder.

With the load sensing control circuit according to this embodiment, the flow dividing ratio modification valve CV is provided in the drain passage 13 that connects the first pressure chamber 10 of the compensator valve C2 to the tank T, and therefore the pressure in the first pressure chamber 10 can be controlled by the flow dividing ratio modification valve CV.

Hence, by keeping the pressure in the first pressure chamber 10 of the compensator valve C2 low using the flow dividing ratio modification valve CV, the compensator valve C2 being connected to the actuator A2 in which the flow dividing ratio is to be reduced relative to the actuator A1 which the flow dividing ratio is to be increased, the opening of the compensator valve C2 can be kept small.

When the opening of the compensator valve C2 can be kept small in this manner, the flow supplied to the actuator A2 connected to the compensator valve C2 can be reduced, and as a result, a relative increase can be achieved in the flow supplied to the target actuator A1.

Therefore, a construction machine or the like in which a particular boom cylinder or the like is incorporated can be handled simply by tuning the flow dividing ratio modification valve CV of the load sensing control circuit at the factory shipping stage.

Further, a case in which the need to modify the flow dividing ratio of a specific actuator in accordance with operating conditions arises can be dealt with simply by tuning the flow dividing ratio modification valve CV on site.

With the load sensing control circuit according to this embodiment, the compensator valve C2 can be used as a compensator valve having predetermined design specifications by maintaining the flow dividing ratio modification valve CV in the closed position.

Furthermore, by maintaining the flow dividing ratio modification valve CV in the throttle position, a relative reduction can be realized in the flow dividing ratio of the switch valve to which the compensator valve C2 is connected.

In the load sensing control circuit according to this embodiment, the opening of the first throttle portion 17 in the throttle position of the flow dividing ratio modification valve CV can be varied, and therefore the flow dividing ratio can be set freely within a variable control range of the first throttle portion 17.

An embodiment of the present invention was described above, but the above embodiment is merely one example of an application of the present invention, and the technical scope of the present invention is not limited to the specific configurations of the above embodiment.

In this embodiment, the orifice 16 is a fixed orifice, but instead, the orifice 16 may be a variable orifice and the first throttle portion 17 of the flow dividing ratio modification valve CV may be a fixed orifice. In this case, the orifice 16 functions as the pressure control unit. Further, both the first throttle portion 17 of the flow dividing ratio modification valve CV and the orifice 16 may be variable orifices. In this case, the flow dividing ratio modification valve CV and the orifice 16 function as the pressure control unit. It should be noted that at least one of the first throttle portion 17 and the orifice 16, which serves as a second throttle portion, must be variable. By making at least one of the first throttle portion 17 in the throttle position of the flow dividing ratio modification valve CV and the orifice 16 serving as the second throttle portion variable, one of the flow dividing ratio modification valve CV and the orifice 16 can be used as a damper.

This application claims priority based on Japanese Patent Application No. 2014-108124, filed with the Japan Patent Office on May 26, 2014, the entire contents of which are incorporated into this specification by reference.

The invention claimed is:

1. A load sensing control circuit comprising:

a plurality of actuators;

a variable displacement pump that supplies a pressure fluid to the plurality of actuators;

switch valves provided respectively in connecting passages that connect the variable displacement pump to the respective actuators;

compensator valves provided respectively in the connecting passages between the switch valves and the actuators, the compensator valves each including a first pressure chamber and a second pressure chamber; and a selection unit that selects a maximum load pressure of the plurality of actuators, wherein the variable displacement pump is configured to discharge pressure fluid at a discharge amount corresponding to the load pressure selected by the selection unit; and a pump discharge amount is divided in accordance with respective switch amounts of the switch valves by leading pressure between the compensator valves and the switch valves to the respective first pressure chambers of the compensator valves, leading the maximum load pressure selected by the selection unit to the respective second pressure chambers of the compensator valves, and controlling respective openings of the compensator valves in accordance with respective pressure actions between the first pressure chambers and the second pressure chambers, the load sensing control circuit further comprising:

a drain passage that connects the first pressure chamber of at least one of the compensator valves to a tank; and a pressure control unit provided in the drain passage and that controls a pressure in the first pressure chamber of the at least one of the compensator valves connected to the tank, the pressure control unit is configured to open/close the drain passage, and when opening the drain passage, to increase a differential pressure between the first pressure chamber and the second pressure chamber of the at least one of the compensator valves and to decrease an opening degree of the at least one of the compensator valves compared with when closing the drain passage.

2. The load sensing control circuit as defined in claim 1, wherein the pressure control unit comprises a flow dividing ratio modification valve that is provided in the drain passage and can be switched between a throttle position and a closed position.

3. The load sensing control circuit as defined in claim 2, wherein the flow dividing ratio modification valve comprises a first throttle portion that throttles a flow in the throttle position, and the first throttle portion has a variable opening.

4. The load sensing control circuit as defined in claim 2, wherein the pressure control unit comprises a second throttle portion provided in a passage that connects the flow dividing ratio modification valve to a passage extending between the compensator valve in which the first pressure chamber of the at least one of the compensator valves is connected to the tank and one of the switch valves, and the second throttle portion has a variable opening.

5. The load sensing control circuit as defined in claim 4, wherein the drain passage is connected to a passage that connects the second throttle portion to the first pressure chamber of the at least one of the compensator valves.

6. The load sensing control circuit as defined in claim 1, wherein the pressure control unit comprises:

a flow dividing ratio modification valve that is provided in the drain passage, can be switched between a throttle position and a closed position, and includes a first throttle portion that throttles a flow in the throttle position; and a second throttle portion provided in a passage that connects the flow dividing ratio modification valve to a passage extending between the at least one of the compensator valves in which the first pressure chamber is connected to the tank and one of the switch valves, and at least one of the first throttle portion and the second throttle portion has a variable opening.

7. The load sensing control circuit as defined in claim 1, wherein the drain passage is connected to a passage that connects the first pressure chamber connected to the tank to a passage extending between one of the compensator valves in which the first pressure chamber is connected to the tank and one of the switch valves.

* * * * *